US006216514B1

(12) United States Patent
Bradbury et al.

(10) Patent No.: US 6,216,514 B1
(45) Date of Patent: Apr. 17, 2001

(54) ROLL-FORMING MACHINE

(75) Inventors: Philip E. Bradbury, McPherson; Karl E. Voth, Hesston; Wayne Fisher, Moundridge, all of KS (US)

(73) Assignee: The Bradbury Company, Inc., Moundridge, KS (US)

( * ) Notice: Subject to any disclaimer, the term of this patent is extended or adjusted under 35 U.S.C. 154(b) by 0 days.

(21) Appl. No.: 09/235,539

(22) Filed: Jan. 22, 1999

(51) Int. Cl.[7] ..... B21D 5/08
(52) U.S. Cl. ..... 72/178; 72/181
(58) Field of Search ..... 72/181, 178, 182, 72/226

(56) References Cited

U.S. PATENT DOCUMENTS

| | | | | |
|---|---|---|---|---|
| 1,125,984 | | 1/1915 | Dumas | 72/181 |
| 1,669,411 | | 5/1928 | Clark . | |
| 1,673,787 | | 6/1928 | Frahm et al. | 72/181 |
| 2,102,355 | | 12/1937 | Cummins | 80/54 |
| 2,150,248 | | 3/1939 | Rosenbaum | 80/55 |
| 2,195,398 | | 4/1940 | Duda | 64/30 |
| 2,294,324 | | 8/1942 | Wilkens et al. | 153/28 |
| 2,343,680 | | 3/1944 | Linderme, Sr. | 205/7 |
| 2,471,490 | * | 5/1949 | Mercer | 72/178 |
| 2,561,634 | | 7/1951 | Picton | 153/54 |
| 2,601,794 | | 7/1952 | Wood | 80/55 |
| 2,664,019 | | 12/1953 | Henderson | 80/35 |
| 2,774,263 | | 12/1956 | Leufven | 80/56 |
| 3,006,225 | | 10/1961 | Mamas | 80/56 |
| 3,345,849 | | 10/1967 | Lowy | 72/249 |
| 3,348,403 | | 10/1967 | Bartley | 72/237 |
| 3,452,568 | | 7/1969 | Vihl | 72/137 |
| 3,724,251 | | 4/1973 | Wegner | 72/203 |
| 3,823,592 | | 7/1974 | Colbath | 72/181 |
| 3,914,971 | * | 10/1975 | Colbath | 72/181 |
| 4,033,165 | | 7/1977 | Arimura et al. | 72/205 |
| 4,142,393 | | 3/1979 | Nagel | 72/181 |
| 4,145,905 | | 3/1979 | Mattie | 72/177 |
| 4,187,710 | | 2/1980 | Stikeleather | 72/204 |
| 4,237,714 | | 12/1980 | Polukhin et al. | 72/242 |
| 4,368,633 | | 1/1983 | Nogota | 72/239 |
| 4,557,129 | | 12/1985 | Lash et al. | 72/176 |
| 4,716,754 | | 1/1988 | Youngs | 72/178 |
| 4,724,695 | | 2/1988 | Stoehr | 72/181 |
| 4,787,232 | | 11/1988 | Hayes | 72/176 |
| 4,912,956 | | 4/1990 | Matricon et al. | 72/243 |
| 4,959,986 | | 10/1990 | Kranis, Sr. | 72/129 |
| 4,969,347 | | 11/1990 | Matsuo et al. | 72/247 |
| 4,974,435 | | 12/1990 | Vandenbroucke | 72/176 |
| 5,158,002 | | 10/1992 | Matsunaga et al. | 83/479 |
| 5,163,311 | | 11/1992 | McClain et al. | 72/181 |
| 5,199,291 | | 4/1993 | Bahl, Jr. et al. | 72/181 |
| 5,259,228 | | 11/1993 | King | 72/180 |
| 5,450,740 | | 9/1995 | Lovinggood et al. | 72/182 |
| 5,644,942 | | 7/1997 | Bradbury | 72/237 |
| 5,829,294 | | 11/1998 | Bradbury et al. | 72/176 |
| 5,829,295 | | 11/1998 | Voth et al. | 72/181 |

FOREIGN PATENT DOCUMENTS

| | | | | |
|---|---|---|---|---|
| 22267 | * | 8/1978 | (AU) | 72/181 |
| 1 777 039 | | 10/1971 | (DE) . | |
| 42-4763 | | 2/1967 | (JP) . | |
| 47 37833 | | 9/1972 | (JP) . | |
| 126319 | * | 9/1980 | (JP) | 72/181 |
| 181428 | * | 10/1983 | (JP) | 72/181 |
| 1085708 | | 4/1984 | (SU) . | |
| WO 98/26884 | | 6/1998 | (WO) | 72/181 |

* cited by examiner

*Primary Examiner*—Daniel C. Crane
(74) *Attorney, Agent, or Firm*—Marshall, O'Toole, Gerstein, Murray & Borun

(57) ABSTRACT

A roll-forming apparatus is provided with a plurality of roll-forming stations adapted to facilitate the formation of either a C-shaped component or a Z-shaped component from a sheet of material. The roll-forming stations have forming rolls that make contact with the sheet of material and a pair of telescoping arbor assemblies that support the forming rolls so that the lateral distance between the forming rolls may be adjusted. The roll-forming apparatus has a number of movable forming rolls and a number of fixed forming rolls having two different forming surfaces to facilitate the formation of both C-shaped and Z-shaped components.

28 Claims, 11 Drawing Sheets

ROLL-FORMING MACHINE

BACKGROUND OF THE INVENTION

The present invention relates to a roll-forming machine of the type which is used to form components, such as purlins, having C-shaped and Z-shaped cross-sections from sheets of planar material.

Roll-forming machines may have a plurality of roll-forming stations that are used to transform a planar sheet of metal into a component having either a C-shaped or Z-shaped cross-sectional area. The component, such as a C-purlin or Z-purlin, typically has a center portion, a pair of leg portions joined to the center portion by a substantially right angle bend formed by the roll-forming machine, and a flange joined to each leg portion by a respective bend formed by the machine.

The flanges of a C- or Z-shaped component may be made first by a plurality, such as three, roll-forming stations. The first of these stations makes an initial pair of bends at the desired lateral locations on the sheet, and then the successive stations for forming the flanges increase the previously made bends until the flanges are at the proper angle relative to the center portion of the sheet. The legs of the component are then formed by a plurality of roll-forming stations in a similar manner.

Each of the roll-forming stations may include a pair of frame members in which a pair of rotatable spindles are journalled, one spindle disposed directly above the other, and a pair of sleeves which cover a portion of the spindles, the sleeves being slidable over the spindles. Each roll-forming station includes at least two pairs of generally cylindrical plates, referred to herein as "forming rolls," two of the forming rolls being fixed to the spindles and the other two forming rolls being fixed to the sleeves. The circumferential ends of the upper and lower forming rolls are vertically spaced apart by a distance corresponding to the thickness of the sheet of material being bent, and the shape or contour of the forming rolls controls the degree to which the sheet is bent. The use of sleeves which are slidable on the spindles and which rotate with the spindles allows the horizontal spacing of the forming rolls on each spindle and sleeve to be varied so that the transverse widths of the center portion and the leg portions of the components being formed can be adjusted.

The sheet of material is forced through the roll-forming machine by friction between the sheet and the rotating forming rolls. The forming rolls of a plurality of the roll-forming stations, e.g. the forming rolls of every other station, are rotatably driven to ensure that there is enough driving power to force the sheet through the machine.

In the case of a C-shaped component, the flanges are made by bending the lateral ends of the sheet in the same direction, for example, downwards, whereas for a Z-shaped component the flanges are made by bending the lateral sheet ends in opposite directions. After the flanges are formed on the lateral ends of the sheet, the legs are formed by a plurality of roll-forming stations by a similar process. To form a component in the above manner, up to ten or more roll-forming stations may be incorporated in the roll-forming machine.

One prior art roll-forming machine incorporates a first set of roll-forming stations adapted to form a Z-shaped component and a second set of roll-forming stations adapted to form a C-shaped component. The two sets of roll-forming stations are driven by a common drive mechanism, connectable to a plurality of roll-forming stations of each set by a pair of coupler mechanisms, so that only one of the sets of roll-forming stations is operable at a time. The forming rolls of both sets of roll-forming stations are horizontally adjustable, as described above, so that the transverse dimensions of the Z- and C-shaped components can be varied.

In the prior art roll-forming machine described above, in order to produce C-shaped components having different transverse dimensions, a pair of forming rolls which were disposed in a number of the roll-forming stations and which were adapted to make flush contact with the flanges of the C-shaped component had to be changed. In particular, where a C-shaped component having a first leg length was to be formed, after the leg portions were substantially formed, the flanges of the component would extend downwards by a distance corresponding to the leg length.

In order to ensure that the forming rolls designed to make flush contact with the flanges made such contact, those forming rolls had to be selected to have a diameter which ensured that the outer cylindrical surfaces of those forming rolls made contact with the flanges of the component. The position of those forming rolls could not be adjusted since they were fixed to a fixed-position spindle and sleeve rotatably journalled in a pair of frame members. Consequently, where C-shaped components having different leg lengths were to be formed, the forming rolls of a number of the roll-forming stations would have to be physically removed and replaced with forming rolls having different diameters.

In the prior art roll-forming machine described above, some of the roll-forming stations used to form Z-shaped components used a pair of angled contact rollers, one of which was disposed to make contact with the Z-shaped component at the inner portion of the bend in the sheet between the center portion and one of the leg portions, and the other of which was disposed to make contact with the Z-shaped component at the inner portion of the bend in the sheet between the center portion and the other leg portion. The position of each of those contact rollers was horizontally adjustable.

A number of roll-forming machines have been designed to form either C-shaped components or Z-shaped components in an economical manner. Examples of such roll-forming machines are disclosed in U.S. Pat. No. 5,829,294 to Philip Bradbury, et al. which is entitled "Split Level Roll Former," and U.S. Pat. No. 5,829,295 to Karl Voth, et al. and entitled "Roll-Forming Machine."

SUMMARY OF THE INVENTION

The invention is directed to a roll-forming apparatus of the type which is used to form components, such as purlins, having C-shaped and/or Z-shaped cross-sections from sheets of planar material.

In one aspect, the invention is directed to a roll-forming apparatus having a first roll-forming station adapted to facilitate the formation of either a C-shaped component or a Z-shaped component from a sheet of material and which makes a pair of bends in the sheet of material at a first pair of locations on the sheet of material laterally spaced apart by a first distance. The first roll-forming station has a first pair of forming rolls that make contact with the sheet of material, a first telescoping arbor assembly that supports the first pair of forming rolls and which has a variable length to allow the lateral distance between the first pair of forming rolls to be adjusted, a second pair of forming rolls that make contact with the sheet of material and a second telescoping arbor assembly that supports the second pair of forming rolls and which has a variable length to allow the lateral distance between the second pair of forming rolls to be adjusted.

The roll-forming apparatus also has a second roll-forming station adapted to facilitate the formation of either a C-shaped component or a Z-shaped component from a sheet of material and which makes a pair of bends in the sheet of material at a second pair of locations on the sheet of material after the pair of bends are made in the sheet of material by the first roll-forming station, the second pair of locations being laterally spaced apart by a second distance smaller than the first distance. The second roll-forming station has a first pair of forming rolls that make contact with the sheet of material, a first telescoping arbor assembly having a variable length that supports the first pair of forming rolls of the second roll-forming station, a second pair of forming rolls that make contact with the sheet of material, and a second variable length telescoping arbor assembly that supports the second pair of forming rolls of the second roll-forming station.

The roll-forming apparatus may also include a movable forming roll having a forming surface and a support that is adapted to support the movable forming roll in a first position in which the forming surface of the movable forming roll makes contact with a sheet of material being made into a Z-shaped component and in a second position in which the forming surface of the movable forming roll makes contact with a sheet of material being made into a C-shaped component.

In another aspect, the invention is directed to a roll-forming apparatus having a first roll-forming station adapted to facilitate the formation of either a C-shaped or Z-shaped component from a sheet of material, the first roll-forming station making a bend in the sheet of material and having a plurality of forming rolls, a second roll-forming station adapted to facilitate the formation of either a C-shaped component or a Z-shaped component from a sheet of material, the second roll-forming station making a bend in the sheet of material and having a plurality of forming rolls, and a two-surface forming roll having a first forming surface and a second forming surface. The two-surface forming roll is positioned so that the first forming surface makes contact with the sheet of material when the sheet is being formed into a Z-shaped component and so that the second forming surface makes contact with the sheet of material when the sheet is being formed into a C-shaped component.

The invention may also include a forming roll support that supports the two-surface forming roll in a fixed position so that the two-surface forming roll may make contact with a sheet of material being formed into a C-shaped component when the two-surface forming roll is in the fixed position and so that the two-surface forming roll may make contact with a sheet of material being formed into a Z-shaped component when the two-surface forming roll is in the same fixed position.

The invention is also directed to a roll-forming apparatus having a total number of roll-forming stations including a first roll-forming station which is adapted to facilitate the formation of either a C-shaped or Z-shaped component from a sheet of material. The first roll-forming station has a forming roll with a forming surface and which is movable between a first position in which the forming surface makes contact with a sheet of material being made into a Z-shaped component and a second position in which the forming surface makes contact with a sheet of material being made into a C-shaped component.

The roll-forming apparatus also includes a plurality of second roll-forming stations which are adapted to facilitate the formation of either a C-shaped or Z-shaped component from a sheet of material. Each of the second roll-forming stations has a plurality of forming rolls that are disposed in fixed positions so that the forming rolls may make contact with a sheet of material being formed into a C-shaped component when the forming rolls are in the fixed positions and so that the forming rolls may make contact with a sheet of material being formed into a Z-shaped component when the forming rolls are in the same fixed positions. The second roll-forming stations do not having any forming rolls that must be moved in order to make contact with a sheet of material being formed into a C-shaped component and to make contact with a sheet of material being formed into a Z-shaped component.

In another aspect, the invention is directed to a roll-forming station for facilitating the formation of either a Z-shaped or C-shaped component from a sheet of material and which makes a pair of bends in the sheet of material at a first pair of laterally spaced locations on the sheet of material. The roll-forming station includes a first pair of forming rolls that make contact with the sheet of material, a first telescoping arbor assembly that supports the first pair of forming rolls and which has a variable length to allow the lateral distance between the first pair of forming rolls to be adjusted, a second pair of forming rolls that make contact with the sheet of material, a second telescoping arbor assembly that supports the second pair of forming rolls and which has a variable length to allow the lateral distance between the second pair of forming rolls to be adjusted, a first support plate that rotatably supports a first end of each of the arbor assemblies, a second support plate laterally spaced from the first support plate that rotatably supports a second end of each of the arbor assemblies, and a two-surface forming roll.

The two-surface forming roll has a first forming surface and a second forming surface and may be positioned so that the first forming surface makes contact with a sheet of material being formed into a Z-shaped component and so that the second forming surface makes contact with a sheet of material being formed into a C-shaped component.

The invention is also directed to a roll-forming station for facilitating the formation of either a Z-shaped component or a C-shaped component from a sheet of material. The roll-forming station includes a first pair of forming rolls that make contact with the sheet of material, a first telescoping arbor assembly that supports the first pair of forming rolls and which has a variable length to allow the lateral distance between the first pair of forming rolls to be adjusted, a second pair of forming rolls that make contact with the sheet of material, a second telescoping arbor assembly that supports the second pair of forming rolls and which has a variable length to allow the lateral distance between the second pair of forming rolls to be adjusted, a first support plate that rotatably supports a first end of each of the arbor assemblies, a second support plate laterally spaced from the first support plate that rotatably supports a second end of each of the arbor assemblies, a movable forming roll having a forming surface, and a support assembly adapted to support the movable forming roll.

The support assembly supports the movable forming roll at a first elevation at which the forming surface of the movable forming roll makes contact with a sheet of material that is being made into a Z-shaped component and at a second elevation at which the forming surface of the movable forming roll makes contact with a sheet of material that is being made into a C-shaped component.

The invention is also directed to a method of forming components which includes the steps of: (a) feeding a first sheet of material into a roll-forming machine having a plurality of fixed roll-forming stations and a plurality of reconfigurable roll-forming stations so that the first sheet of material passes through each of the fixed and reconfigurable roll-forming stations so that the first sheet of material is formed into a C-shaped component. The reconfigurable roll-forming stations have a first configuration designed to produce C-shaped components and a second configuration designed to produce Z-shaped components, and the fixed roll-forming stations having a single configuration designed to produce both C-shaped components and Z-shaped components. The method also includes the steps of (b) changing the configuration of each the reconfigurable roll-forming stations from the first configuration to the second configuration without changing the single configuration of the fixed roll-forming stations after the first sheet of material is formed into a C-shaped component, and (c) feeding a second sheet of material into the roll-forming machine so that the second sheet of material passes through each of the fixed and reconfigurable roll-forming stations so that the second sheet of material is formed into a Z-shaped component. The invention is also directed to a similar method where Z-shaped components are made first, then the roll-forming machine is reconfigured to make C-shaped components.

The invention is also directed to a roll-forming apparatus having a plurality of roll-forming stations which are adapted to facilitate the formation of C-shaped components and Z-shaped components from sheets of material and a component straightener that is adapted to straighten both C-shaped components and Z-shaped components. The component straightener includes a frame, a first straightener fixture associated with the frame and having at least two forming rolls adapted to straighten a C-shaped component, a second straightener fixture associated with the frame and having at least two forming rolls adapted to straighten a Z-shaped component, and an actuator that causes the first straightener fixture to be aligned to receive C-shaped components from the roll-forming stations when they are forming C-shaped components and the second straightener fixture to be aligned to receive Z-shaped components from the roll-forming stations when they are forming Z-shaped components.

The frame may be composed of a stationary frame portion and a movable frame portion supported by the stationary frame portion, and the first and second straightener fixtures may be supported by the movable frame portion. The components being formed by the roll-forming stations may exit the roll-forming stations at an exit elevation, and the actuator may cause one of the straightener fixtures to be vertically moved to the exit elevation so that the component enters the one straightener fixture at that elevation.

The features and advantages of the invention will be apparent to those of ordinary skill in the art in view of the detailed description of the preferred embodiment, which is made with reference to the drawings, a brief description of which is provided below.

DETAILED DESCRIPTION OF THE PREFERRED EMBODIMENTS

Figure 1:
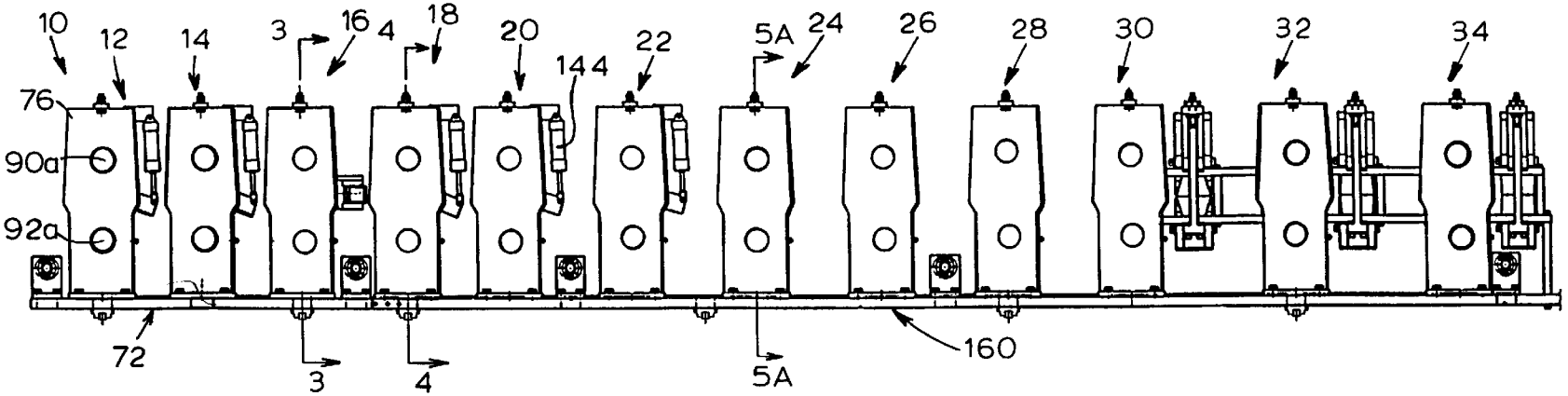
FIG. 1 is a side view of a portion of a preferred embodiment of a roll-forming machine in accordance with the invention.

FIG. 1 illustrates a schematic side view of a preferred embodiment of a roll-forming machine 10 in accordance with the invention with portions of the roll-forming machine omitted for sake of clarity. The roll-forming machine 10 is adapted to selectively form either C- or Z-shaped components from sheets of material using a single row of roll-forming stations aligned in a linear direction.

The roll-forming machine 10 includes two basic types of roll-forming stations: 1) roll-forming stations in which all of the forming rolls are disposed in a single, "fixed" position, regardless of whether a C-shaped or Z-shaped component is being formed, which are referred to herein as "fixed" roll-forming stations; and 2) roll-forming stations which include a least one forming roll that must be moved in order to reconfigure the roll-forming machine 10 to make C-shaped components after it has made Z-shaped components, and vice versa, which are referred to herein as "reconfigurable" roll-forming stations.

The term "fixed" used in connection with the first type of roll-forming station noted above does not preclude the ability of the position of a forming roll to be adjusted to accommodate, for example, differences in thickness of the sheets of material from which the components are being formed.

Referring to FIG. 1, the roll-forming machine 10 is composed of a total of twelve roll-forming stations 12–34. When a sheet of material is being formed into a component, the sheet is passed from left to right in FIG. 1, so that the sheet initially enters the roll-forming station 12 and eventually reaches the roll-forming station 34. Of those twelve roll-forming stations, the first six roll-forming stations 12, 14, 16, 18, 20 and 22 are reconfigurable and the last six roll-forming stations 24, 26, 28, 30, 32 and 34 are fixed. The roll-forming machine 10 could be provided with more than or fewer than twelve roll-forming stations.

Figure 1B:
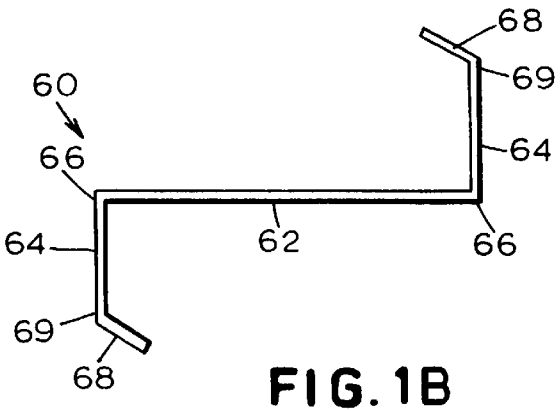
FIG. 1B illustrates a Z-shaped component that may be produced by the roll-forming machine.
Figure 1A:
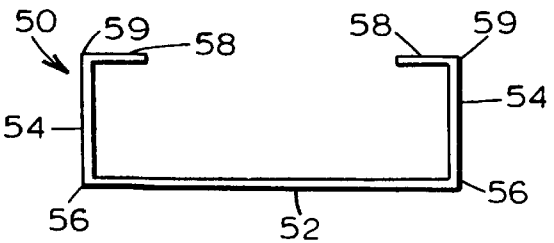
FIG. 1A illustrates a C-shaped component that may be produced by the roll-forming machine.

FIG. 1A illustrates an end view of an exemplary C-shaped component 50 that may be formed by the roll-forming machine 10 from a sheet of material. That C-shaped component 50 has a center portion 52, a pair of legs 54 adjacent the center portion 52 and separated from the center portion 52 by a pair of bends 56, and a pair of flanges 58 adjacent the legs 54 and separated from the legs 54 by a pair of bends 59.

FIG. 1B illustrates an end view of an exemplary Z-shaped component 60 that may be formed by the roll-forming machine 10 from a sheet of material. That Z-shaped component 60 has a center portion 62, a pair of legs 64 adjacent the center portion 62 and separated from the center portion 62 by a pair of bends 66, and a pair of flanges 68 adjacent the legs 64 and separated from the legs 64 by a pair of bends 69. The C- and Z-shaped components referred to herein include components that have a non-linear center portion 52 or 62.

The roll-forming machine 10 forms C- and Z-shaped components, which may be referred to as "purlins" and which are typically formed from sheets of steel, by successively making bends in the sheet of steel at room temperature. The first three roll-forming stations 12, 14, 16 are used to form the flanges 58, 68 of the components 50, 60 by making an initial pair of bends in the sheet of material at the laterally spaced apart bend locations 59, 69, respectively, and then making further bends at those locations 59, 69 until the flanges 58, 68, respectively, occupy the desired angled orientation relative to the legs 54, 64, respectively.

The remaining roll-forming stations 18–34 are used to form the legs 54, 64 of the components by making a second pair of bends in the sheet of material, the second pair of bends being spaced apart by a lateral distance smaller than the first pair of bends, until legs 54, 64 occupy the desired angled orientation relative to the center portions 52, 62, respectively.

Figure 2A:
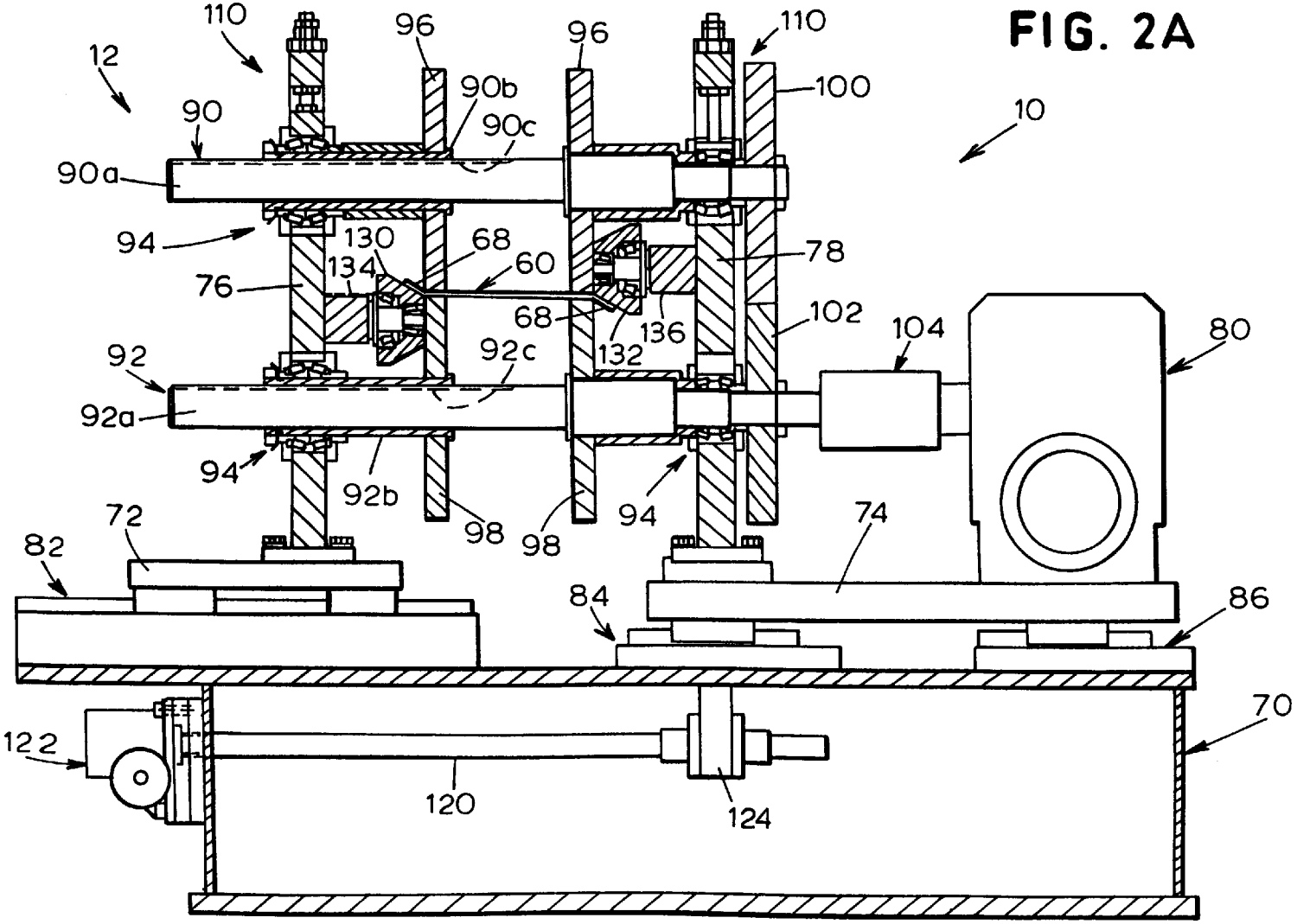
FIG. 2A illustrates a first roll-forming station of the roll-forming machine with a movable forming roll shown in a lowered position.

FIG. 2A is an elevational view, with portions shown in cross section, of the first roll-forming station 12 along with other portions of the roll-forming machine 10. Referring to FIG. 2A, the roll-forming machine 10 has a base 70 on which an outboard support plate 72 and an inboard support plate 74 are supported. The outboard support plate 72 supports three outboard roll stands 76, one for each of the three roll-forming stations 12, 14, 16. The inboard support plate 74 supports three inboard roll stands 78, one for each of the three roll-forming stations 12, 14, 16, and a conventional drive mechanism 80. As used herein, the term "inboard" is used to describe a component that is situated relatively close to the drive mechanism 80, and the term "outboard" is used to describe a component that is situated relatively far from the drive mechanism 80.

The outboard support plate 72 is supported on a slide bearing fixture 82 which allows the position of the support plate 72 (and the outboard roll stands 76 of the three roll-forming stations 12, 14, 16 fixed to the support plate 72 to be laterally adjusted. The inboard support plate 74 is supported on a pair of slide bearing fixtures 84, 86, which allows the position of the support plate 74 (and the inboard roll stands 78 of the three roll-forming stations 12, 14, 16 and the drive mechanism 80) to be laterally adjusted.

The roll stands 76, 78 of each of the roll-forming stations 12, 14, 16 support an upper telescoping arbor assembly 90 and a lower telescoping arbor assembly 92. The upper arbor assembly 90 includes a solid arbor 90*a* and a cylindrical sleeve 90*b*, and the lower arbor assembly 92 includes a solid arbor 92*a* and a cylindrical sleeve 92*b*. Each sleeve 90*b*, 92*b* is slidable along the longitudinal axis of its respective arbor 90*a*, 92*a*, but each sleeve 90*b*, 92*b* is rotatably fixed to its respective arbor 90*a*, 92*a*, such as by keying each sleeve 90*b*, 92*b* into a respective elongate slot 90*c*, 92*c* formed in each arbor 90*a*, 92*a*, so that rotation of the arbors 90*a*, 92*a* forces the sleeves 90*b*, 92*b* to rotate.

The arbor assemblies 90, 92 are rotatably journalled in the roll stands 76, 78 by a number of conventional bearing assemblies 94, two of which are disposed in each outboard roll stand 76 and two of which are disposed in each inboard roll stand 78. A pair of upper cylindrical forming rolls 96 are fixed to the upper telescoping arbor assembly 90, one of the forming rolls 96 being fixed to the sleeve 90*b* and the other being fixed to the arbor 90*a*, and a pair of lower cylindrical forming rolls 98 are fixed to the lower telescoping arbor assembly 92, one of the forming rolls 98 being fixed to the sleeve 92*b* and the other being fixed to the arbor 92*a*. The forming rolls 96, 98 are fixed to the arbor assemblies 90, 92 so that rotation of the arbor assemblies 90, 92 causes rotation of the forming rolls 96, 98.

The arbor assemblies 90, 92 are rotatably driven by a drive system which includes a pair of intermeshed drive gears 100, 102, each of which is fixed to a respective one of the arbor assemblies 90, 92, and a conventional coupling mechanism, schematically shown at 104, between the lower drive gear 102 and the drive mechanism 80. As is known, not all of the arbor assemblies 90, 92 of the roll-forming machine need to be rotatably driven by the drive mechanism 80. Some roll-forming stations can be undriven, and other roll forming stations can be indirectly driven, such as by gearing or chains connected between adjacent roll-forming stations.

Each of the roll stands 76, 78 that supports the arbor assemblies 90, 92 includes a conventional adjustment mechanism 110 which may be used to either raise or lower the upper arbor assembly 90 so that the spacing between the forming rolls 96, 98 may be adjusted to accommodate sheets of material having different thicknesses.

The lateral spacing of the roll stands 76, 78 of the first three roll-forming stations 12, 14, 16 may be adjusted by an elongate positioning screw 120 that is driven by a motor assembly 122. An internally threaded positioning coupler 124 is coupled to the positioning screw 120 so that rotation of the screw 120 causes linear translation of the support plate 74 relative to the support plate 72. The positioning coupler 124 may be connected to the underside of the support plate 74 through a slot (not shown). The position of the outboard support plate 72 may be adjusted by a separate mechanism (not shown), which may be the same or similar to the positioning mechanism described above which causes translation of the support plate 74.

Referring to FIG. 2A, the roll-forming machine 10 has an outboard forming roll 130 and an inboard forming roll 132. The outboard forming roll 130 is supported by a movable support arm 134 that is coupled to the outboard roll stand 76, and the inboard forming roll 132 is supported by a fixed support arm 136 connected to the inboard roll stand 78. Both of the forming rolls 130, 132 are rotatably mounted to the support arms 134, 136 via conventional bearings.

Figure 2B:
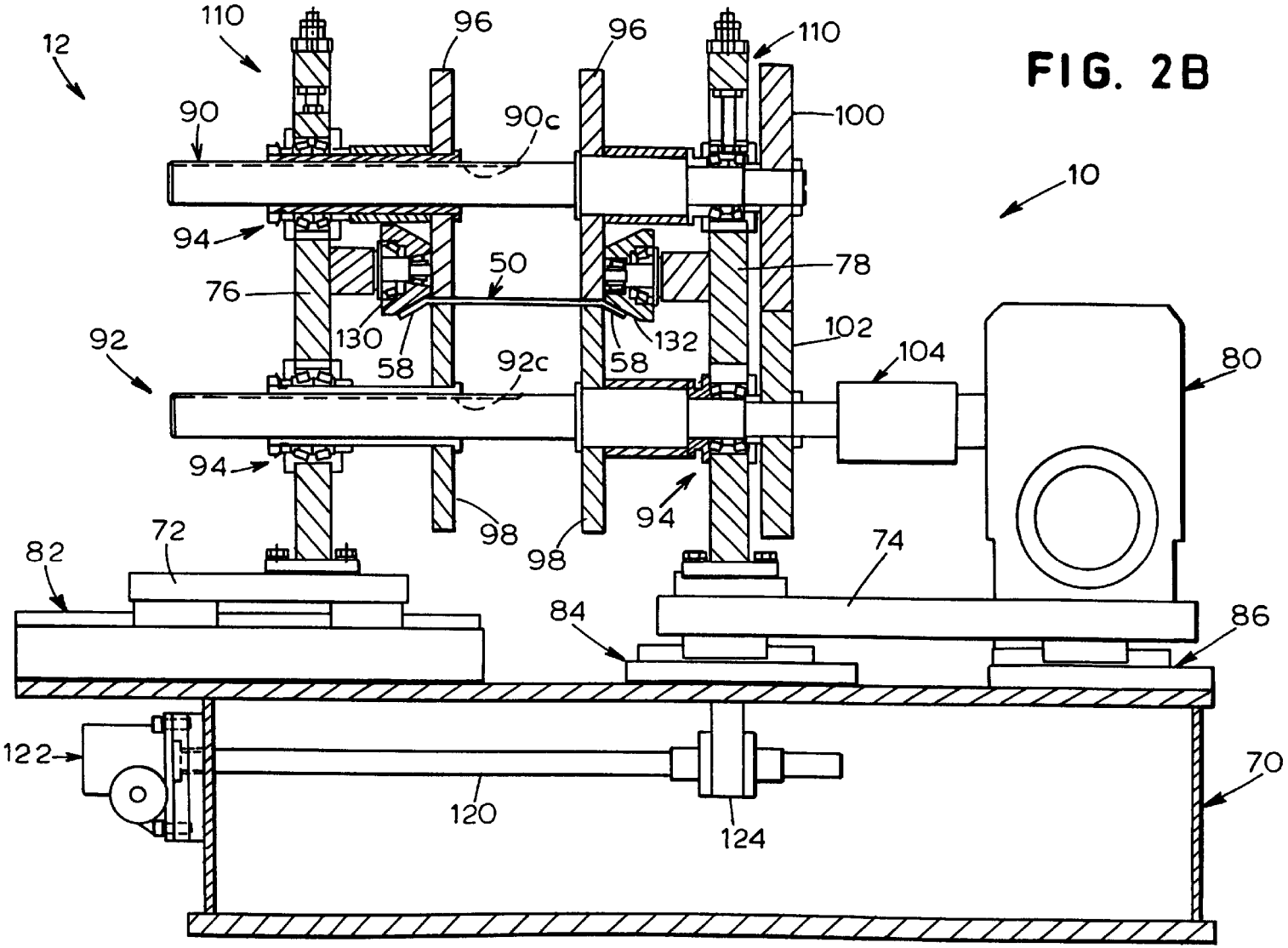
FIG. 2B illustrates the roll-forming station of FIG. 2A with the movable forming roll shown in a raised position.

The outboard forming roll 130 is movable so that it can be moved between a lower position, as shown in FIG. 2A, in order to form the flanges 68 of a Z-shaped component 60, and an upper position, as shown in FIG. 2B, in order to form the flanges 58 of a C-shaped component 50. The manner in which the outboard forming roll 130 is moved is described in connection with FIG. 6.

Figure 6:
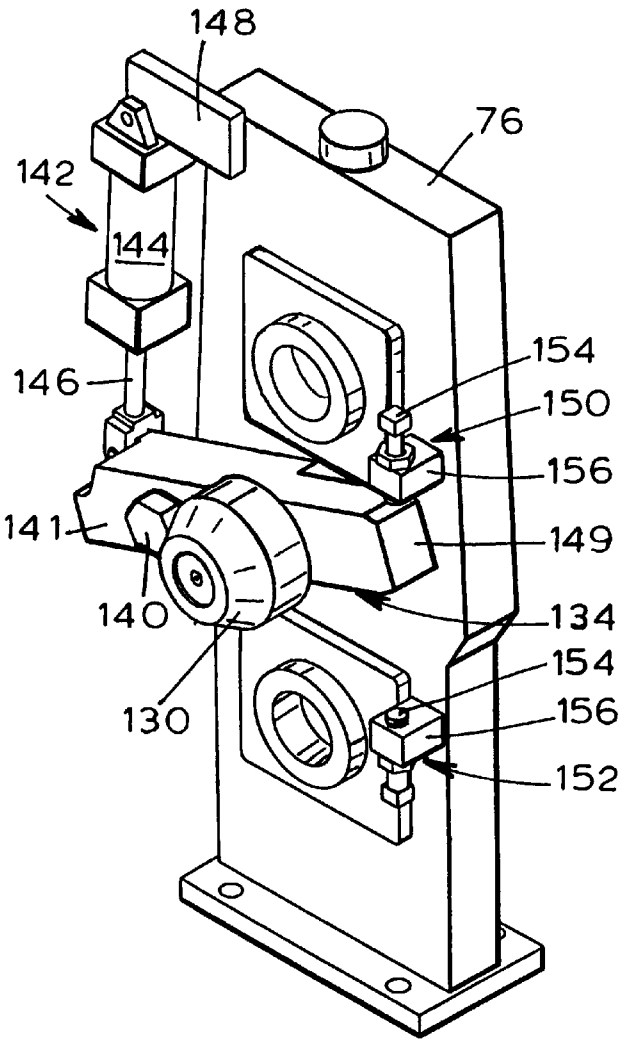
FIG. 6 is a perspective view of a portion of the roll-forming station of FIGS. 2A and 2B.

FIG. 6 is a perspective view of an outboard roll stand 76 and structure that movably supports the outboard forming roll 130. Referring to FIG. 6, the outboard forming roll 130 is rotatably attached to the movable support arm 134, which is pivotally connected to the outboard roll stand 76 at a pivot point via a pivot member 140. A first end 141 of the movable support arm 134 is connected to an actuator 142, which may comprise for example a hydraulic or pneumatic actuator having a cylinder 144 and a piston rod 146 retractable within the cylinder 144. The upper end of the actuator 142 may be connected to the outboard roll stand 76 via a mounting plate 148.

When the piston rod 146 is drawn into the cylinder 144, the end 141 of the support arm 134 is forced upwards, which causes the outboard forming roll 130 to be moved downwards. When the piston 146 is forced out of the cylinder 144, the end 141 of the support arm 134 is forced downwards, which causes the outboard forming roll 130 to be moved upwards.

A second end 149 of the movable support arm 134 may extend between an upper adjustable stop mechanism 150 and a lower adjustable stop mechanism 152 in order to define the permissible range of movement of the support arm 134, and thus the permissible range of vertical movement of the outboard forming roll 130. As shown in FIG. 6, the adjustable stop mechanisms 150, 152 may incorporate a bolt 154 which is adjustably threaded into a mounting block 156 so that the ends of the bolts 154 define the permissible range of movement of the end 149 of the movable support arm 134 by making physical contact with the end 149.

As noted above in connection with FIG. 2A, the lateral spacing between outboard and inboard roll stands 76, 78 is adjustable, so that flanges 58, 68 of different widths may be formed, via an adjustment mechanism that includes the motor assembly 122, the positioning screw 120 and the positioning coupler 124. The lateral spacing between the outboard and inboard roll stands 76, 78 of the roll-forming stations 18–34 that follow the first three roll-forming stations 12, 14, 16 may be adjusted, so that center portions 52, 62 of different lengths may be formed, via a similar adjustment mechanism (not shown). To that end, the outboard roll stands 76 of those roll-forming stations 18–34 may be provided on a separate support plate 160 (FIG. 1) than the support plate 72 that supports the outboard roll stands 76 of the first three roll-forming stations 12, 14, 16, so that lateral spacing of the roll stands 76, 78 of the first three roll-forming stations 12, 14, 16 is adjustable independently of that of the remaining roll-forming stations 18–34.

The structure of the second roll-forming station 14 is substantially the same as that of the first roll-forming station 12 described above, except that the outboard and inboard forming rolls 130, 132 have a slightly different shape so as to bend the flanges 58 or 68 of the component being formed slightly more.

Figure 3:
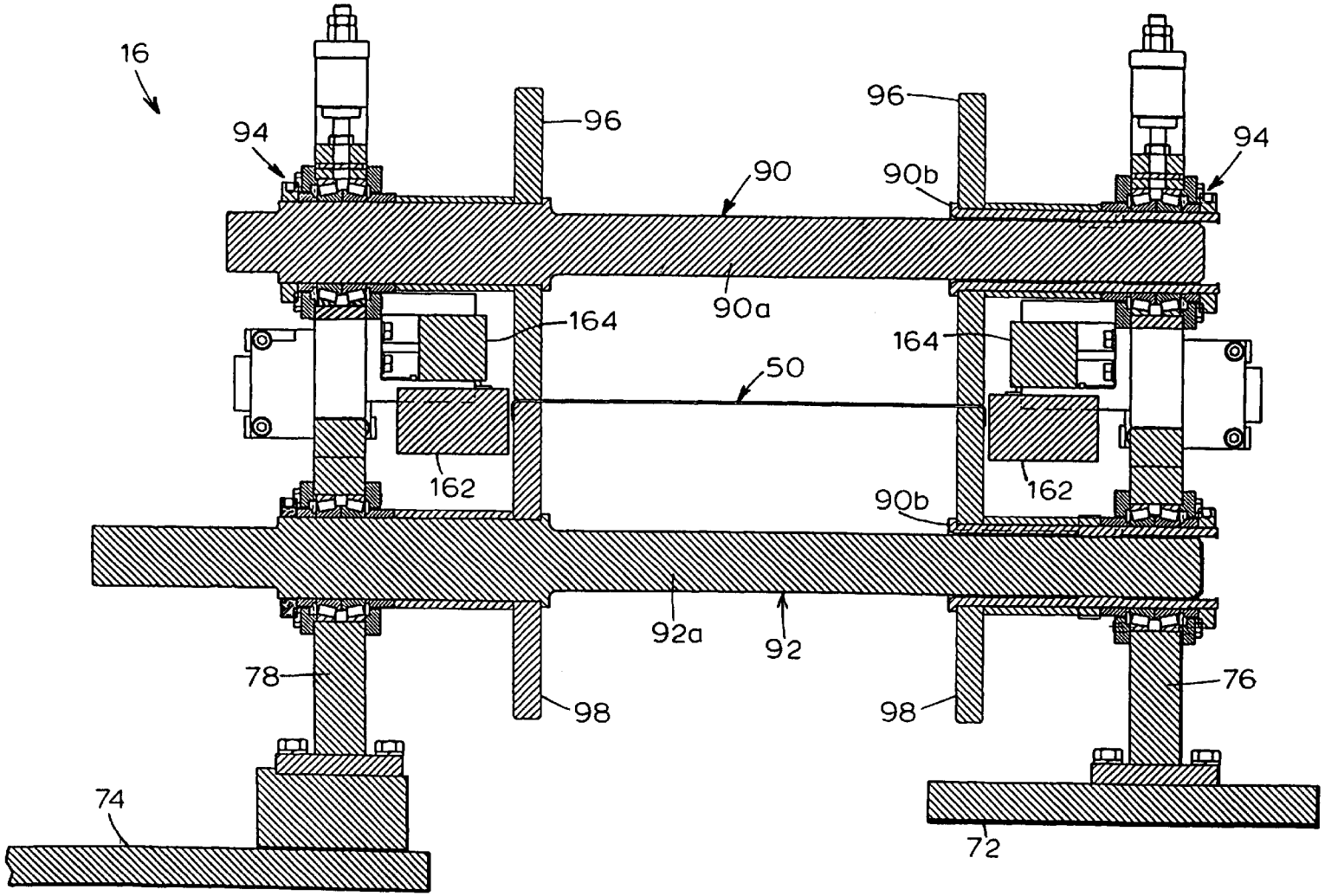
FIG. 3 is a cross-sectional view of one of the roll-forming stations of the roll-forming machine generally taken along the lines 3—3 of FIG. 1.

FIG. 3 is a cross-sectional view of the third roll-forming station 16 generally taken along the lines 3—3 of FIG. 1. The third roll-forming station 16 is used only where a C-shaped component 50 is being formed in order to complete the bending of the flanges 58 so that they are perpendicular to the remaining portion of the sheet of material, as shown in FIG. 1A.

Referring to FIG. 3, the third roil-forming station 16 has a pair of forming rolls 162, each of which is rotatable about a vertical axis. Each of the forming rolls 162 is supported by a laterally movable support arm 164 coupled to one of the roll stands 76, 78 as described below in connection with FIG. 7. When a sheet of material is being formed into a C-shaped component 50, each forming roll 162 is moved to occupy an inner or engaged position in which the forming roll 162 abuts a sheet of material in order to bend the flanges 58 to perpendicular to the central portion 52 of the sheet.

When a sheet of material is being formed into a Z-shaped component 60, each forming roll 162 may be moved to occupy an outer or retracted position in which the forming roll 162 does not make any contact with the sheet. Where a Z-shaped component 60 as shown in FIG. 1B is being formed with flanges 68 that are not perpendicular to the legs 64, it is not desired to make any further bend in the sheet of material at the third roll-forming station 16; consequently, in that case the forming rolls 162 are moved to their retracted position.

Figure 7:
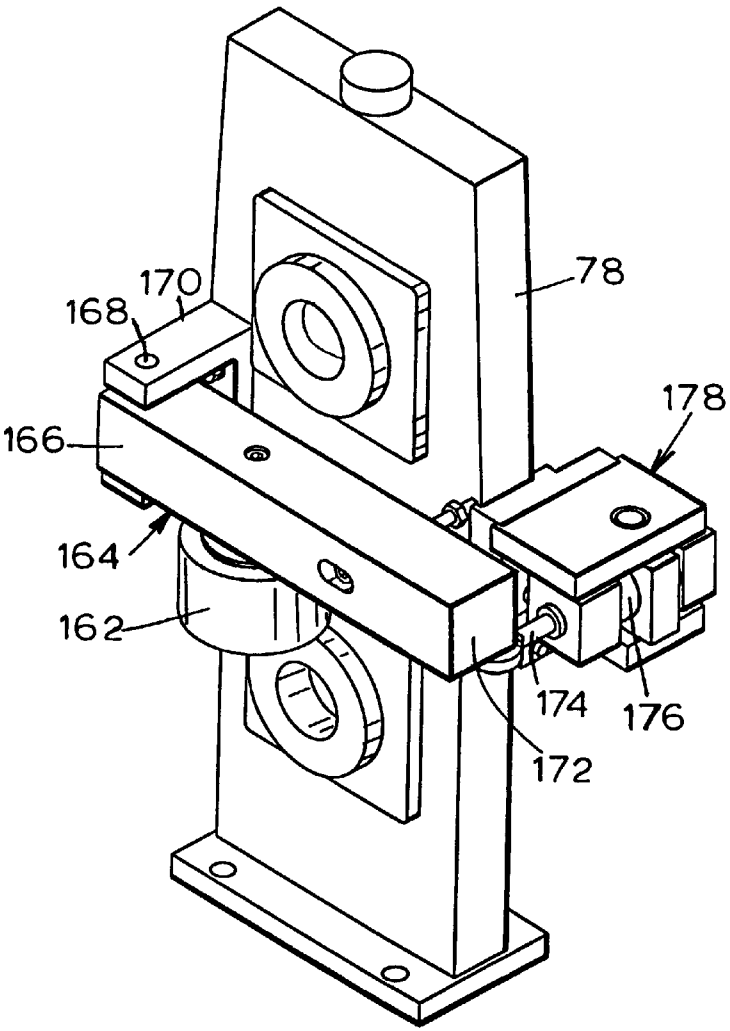
FIG. 7 is a perspective view of a portion of the roll-forming station of FIG. 3.

The manner in which the forming rolls 162 are mounted and the manner in which they are laterally moved is shown in FIG. 7. Referring to FIG. 7, a first end 166 of the movable support arm 164 that carries the forming roll 162 is pivotally connected at a pivot point 168 to a mounting bracket 170 connected to the roll stand 78. The opposite end 172 of the support arm 164 is connected to a piston rod 174 that may be retracted into a pneumatically or hydraulically actuated cylinder 176 mounted to the roll stand 78 via a mounting bracket 178.

When the piston rod 174 is forced out of the cylinder 176, the forming roll 162 is moved towards its engaged position, and when the piston rod 174 is drawn into the cylinder 176, the forming roll 162 is moved towards its retracted position. Mechanical stops to precisely define the retracted and engaged positions of the forming rolls 162 may be used.

Referring to FIGS. 6 and 7, the forming rolls 130, 162 are shown to be mounted to the roll stands 76, 78, respectively. However, those forming rolls 130, 162 and other forming rolls disclosed herein could alternatively be mounted, for example, on separate mounting fixtures not directly connected to the roll stands 76, 78, but instead on mounting fixtures disposed between adjacent roll stands 76, 78.

Figure 4:
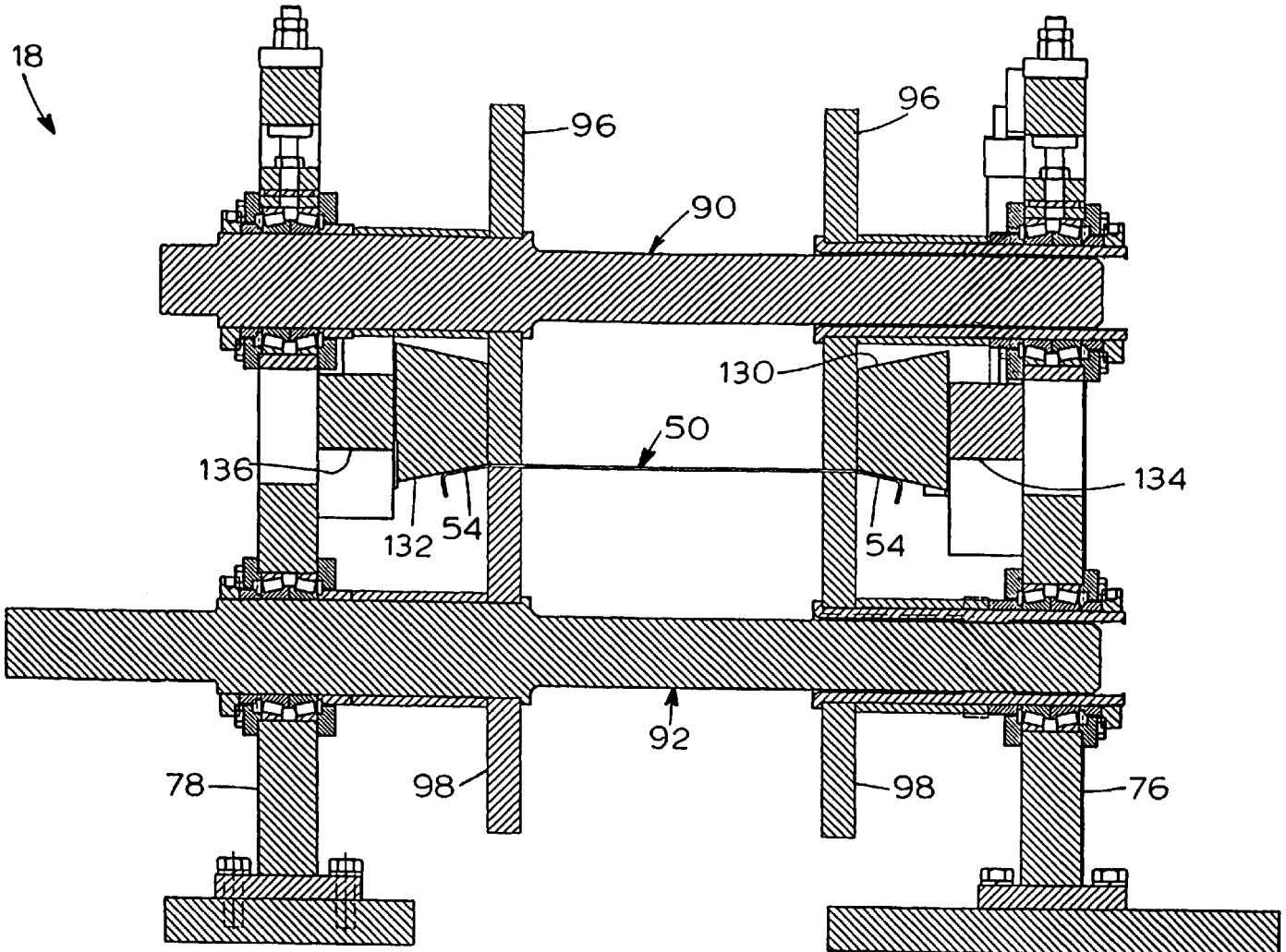
FIG. 4 is a cross-sectional view of one of the roll-forming stations of the roll-forming machine generally taken along the lines 4—4 of FIG. 1.

FIG. 4 is a cross-sectional view of the fourth roll-forming station 18 generally taken along the lines 4—4 of FIG. 1. The fourth roll-forming station 18 is used to begin the formation of the legs 54, 64 of either a C-shaped component 50 or a Z-shaped component 60. The fourth roll-forming station 18 shown in FIG. 4 is generally the same as the first roll-forming station 12 described above in connection with FIGS. 2A and 2B, except that the forming rolls 130, 132 are spaced more closely together so as to begin to bend the legs 54, 64 of either a C-shaped component 50 or a Z-shaped component 60 (the roll-forming station 18 of FIG. 4 is shown from the opposite direction as the roll-forming station 12 of FIGS. 2A and 2B).

When the legs 54 of a C-shaped component 50 are being formed as shown in FIG. 4, the movable forming roll 130 mounted to the support arm 134 is moved to a relatively high position so that the right-hand leg 54 of the C-shaped component 50 is bent downwards. To form the legs 64 of a Z-shaped component 60, the forming roll 130 is moved to a relatively lower position (not shown, but corresponding to the position of the forming roll 130 shown in FIG. 2A) so that the right-hand leg 64 of the Z-shaped component 60 is bent upwards.

Roll-forming stations 20, 22 are substantially the same as the roll-forming station 18 described above, except that the forming rolls 130, 132 of the roll-forming stations 20, 22 are shaped differently so as to bend the legs 54, 64 of the sheet of material to a greater degree.

Figure 5A:
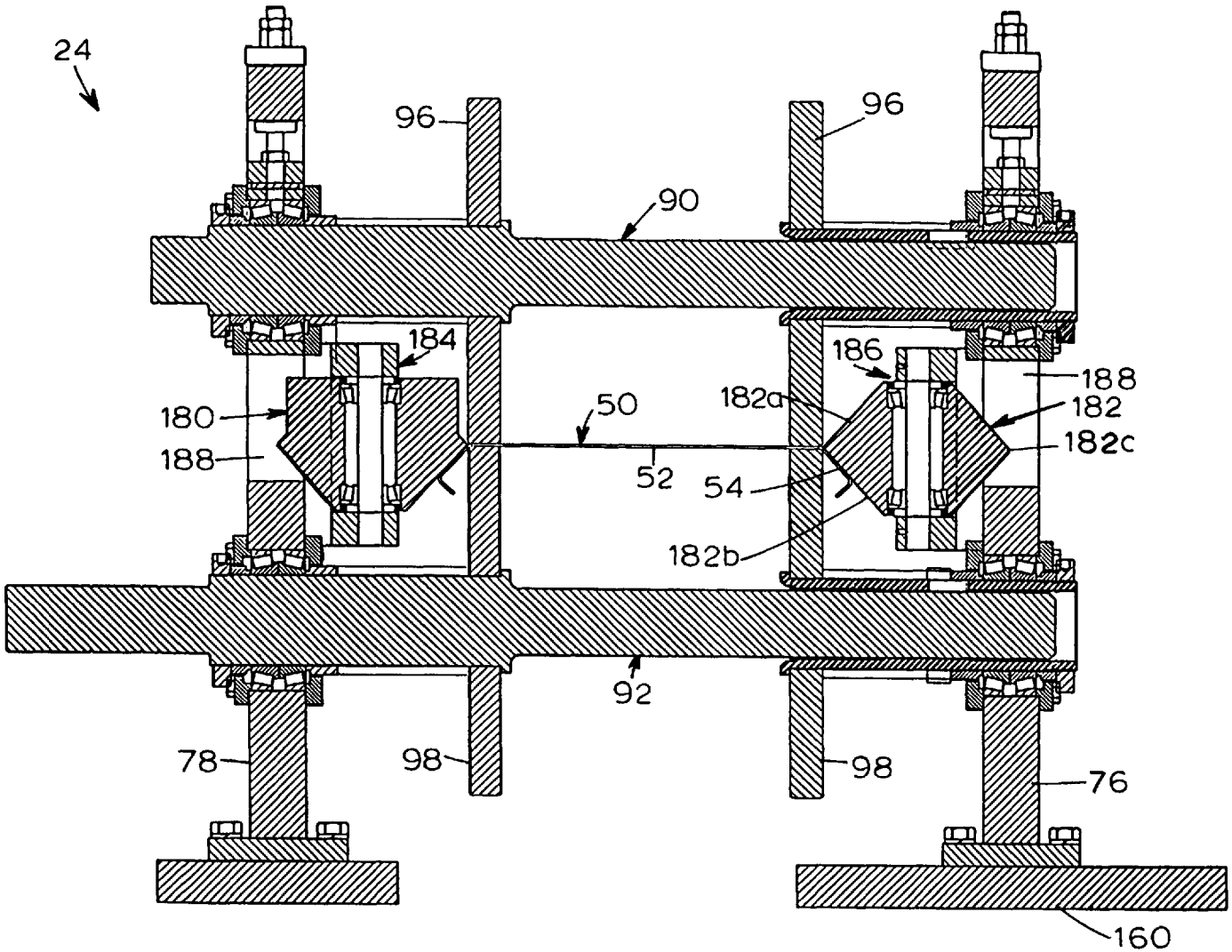
FIG. 5A is a cross-sectional view of one of the roll-forming stations of the roll-forming machine generally taken along the lines 5A—5A of FIG. 1 shown forming a C-shaped component.

FIG. 5A is a cross-sectional view of the seventh roll-forming station 24 generally taken along the lines 5A—5A of FIG. 1. The seventh roll-forming station 24 is used to further bend the legs 54, 64 of either a C-shaped component 50 or a Z-shaped component 60. Referring to FIG. 5A, which illustrates the formation of a C-shaped component 50, the further bending of the legs 54 is accomplished by an inboard forming roll 180 and an outboard forming roll 182. The inboard forming roll 180 is rotatably supported about a vertical axis of rotation by a support assembly 184, and the outboard forming roll 182 is rotatably supported about a vertical axis of rotation by a support assembly 186.

The forming roll 182 has a V-shaped side profile, with an upper forming surface 182*a* and a lower forming surface 182*b* which meet at a junction 182*c*. When a C-shaped component 50 is being formed, as shown in FIG. 5A, the lower forming surface 182*b* makes contact with the right-hand leg 54 of the component 50 to increase the degree of bending between the leg 54 and the central portion 52 of the C-shaped component 50. When a Z-shaped component 60 is being formed, as shown in FIG. 5B, the upper forming surface 182*a* makes contact with the right-hand leg 64 of the component 60 to increase the degree of upward bending of the leg 64 relative to the central portion 62 of the Z-shaped component 60.

Figure 5B:
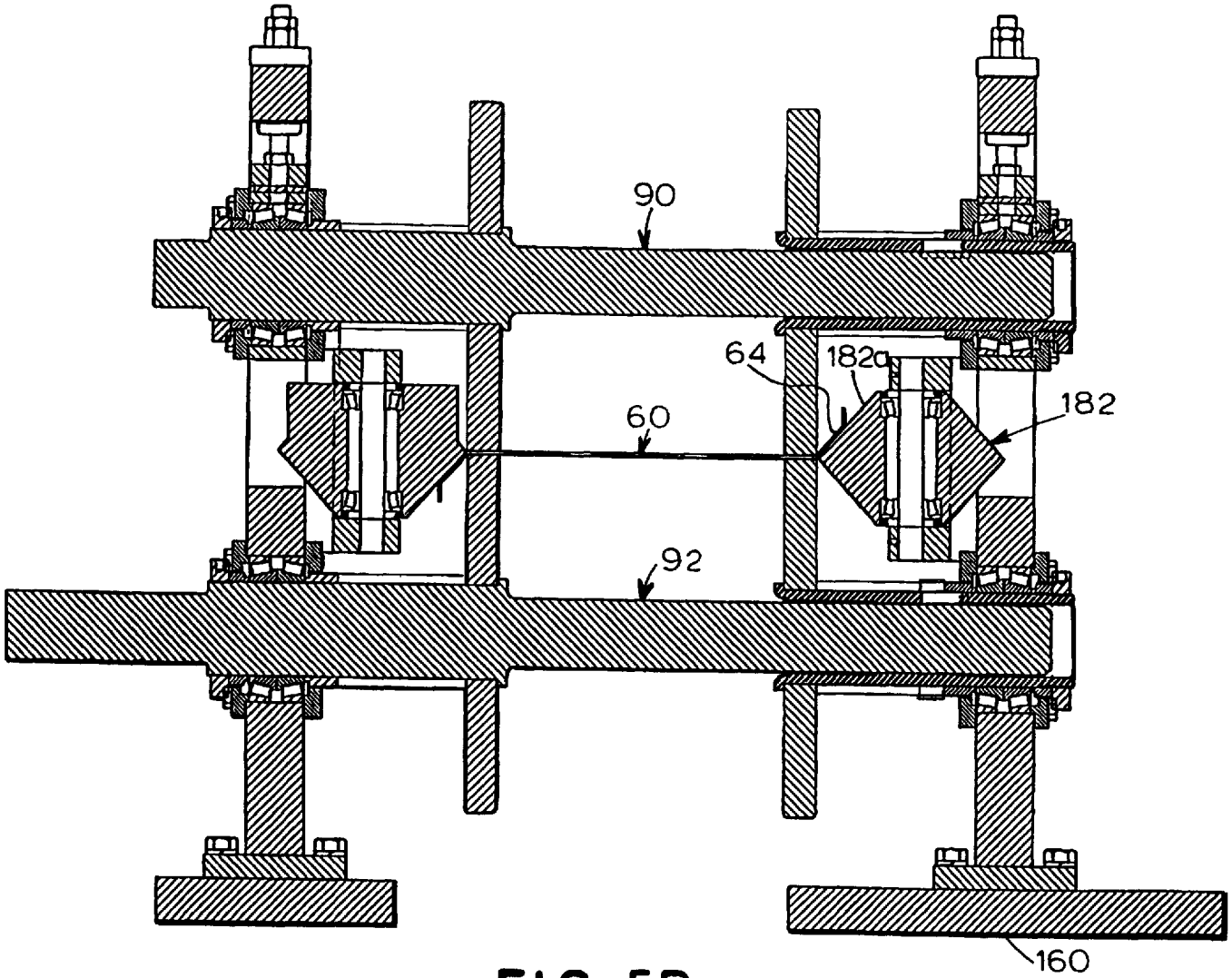
FIG. 5B is a view of the roll-forming station of FIG. 5A shown forming a Z-shaped component.

The support assembly 186 holds the forming roll 182 in a fixed position in which the junction 182*c* of the forming roll 182 is located generally at the same elevation as the vertical midpoint of the center portion 52 or 62 of the sheet of material, as shown in FIGS. 5A and 5B. As a result, when a C-shaped component 50 is being formed as shown in FIG. 5A, the right-hand leg 54 automatically comes into contact with the lower forming surface 182*b,* which increases the bend between the leg 54 and the center portion 52. When a Z-shaped component 60 is being formed, as shown in FIG. 5B, the right-hand leg 64 automatically comes into contact with the upper forming surface 182*a,* which increases the bend between the leg 64 and the center portion 62.

Consequently, when the configuration of the roll-forming machine 10 is changed from a first configuration in which C-shaped components 50 are produced to a second configuration in which Z-shaped components 60 are being produced, it is not necessary to change the position of the forming roll 182. That change in configuration only requires the position of the movable forming rolls 130 and 162 described above in connection with FIGS. 6 and 7 to be changed.

The roll-forming stations 26–34 are similar to the roll-forming station 24 described above in connection with FIGS. 5A and 5B in that each incorporates at least one fixed forming roll having two forming surfaces, like the two-surface forming roll 182 shown in FIGS. 5A and 5B, each of which acts to increase the bend in the component, with one of the forming surfaces of the two-surface forming roll 182 contacting the leg 54 when a C-shaped component 50 is being formed and with the other forming surface contacting the leg 64 when a Z-shaped component 60 is being formed.

Each of the roll stands 76, 78 of the roll-forming stations 12–34 may have one or more apertures formed therein, such as apertures 188 shown in FIG. 5A, to accommodate the various forming rolls associated with the roll stands 76, 78.

Prior to operation, the roll-forming machine 10 is configured to produce either a C-shaped component 50 or a Z-shaped component 60. To that end, each of the reconfigurable roll-forming stations 12–22 may be set to the desired configuration by moving the movable forming rolls 130 to either their upper or lower positions, as shown for example, in FIGS. 2A and 2B. There is no need to configure the fixed roll-forming stations 24–34 since they have a single configuration which may produce both C-shaped components 50 and Z-shaped components 60.

After such initial configuration, the roll-forming machine 10 is used to transform the desired number of sheets into the desired type of components. During operation, each sheet of material is successively bent, as it passes through each of the roll-forming stations 12–34, from a flat sheet of material into either a C-shaped component 50 or a Z-shaped component 60. The flanges of the component are formed by the roll-forming stations 12–16 and the legs of the component are formed by the roll-forming stations 18–34.

When it is desired to use the roll-forming machine 10 to form a different type of component, the configuration of each of the configurable roll-forming stations 12–22 is changed, without the need to change the configuration of the roll-forming stations 24–34, and sheets of material are fed into the roll-forming machine 10 to form the desired components.

Additional features may be incorporated in the roll-forming machine 10, such as features described in U.S. Pat. No. 5,829,295 to Karl Voth, et al., which is incorporated by reference herein in its entirety.

Although the roll-forming machine 10 described above forms the flanges of the Z- and C-shaped components 50, 60 before forming the legs of those components, the machine 10 could be modified so that the legs of the Z- and/or C-shaped components 50, 60 are formed before the flanges.

The roll-forming machine 10 may include a component straightener 200 in order to straighten the C- and Z-shaped components 50, 60 after they are formed by the roll-forming stations 12–34. The component straightener 200 may be used to correct any one or more of the following conditions in a C-shaped and/or a Z-shaped component: 1) flare; 2) twist; 3) vertical bow; and 4) horizontal bow. The straightener 200 does not make large bends in the component being formed, a "large" bend being defined herein as a bend of greater than about five degrees of one portion of the component (e.g. the leg 54 of a C-shaped component 50) relative to another portion of the component (e.g. the center portion 52 of a C-shaped component).

Figure 8:
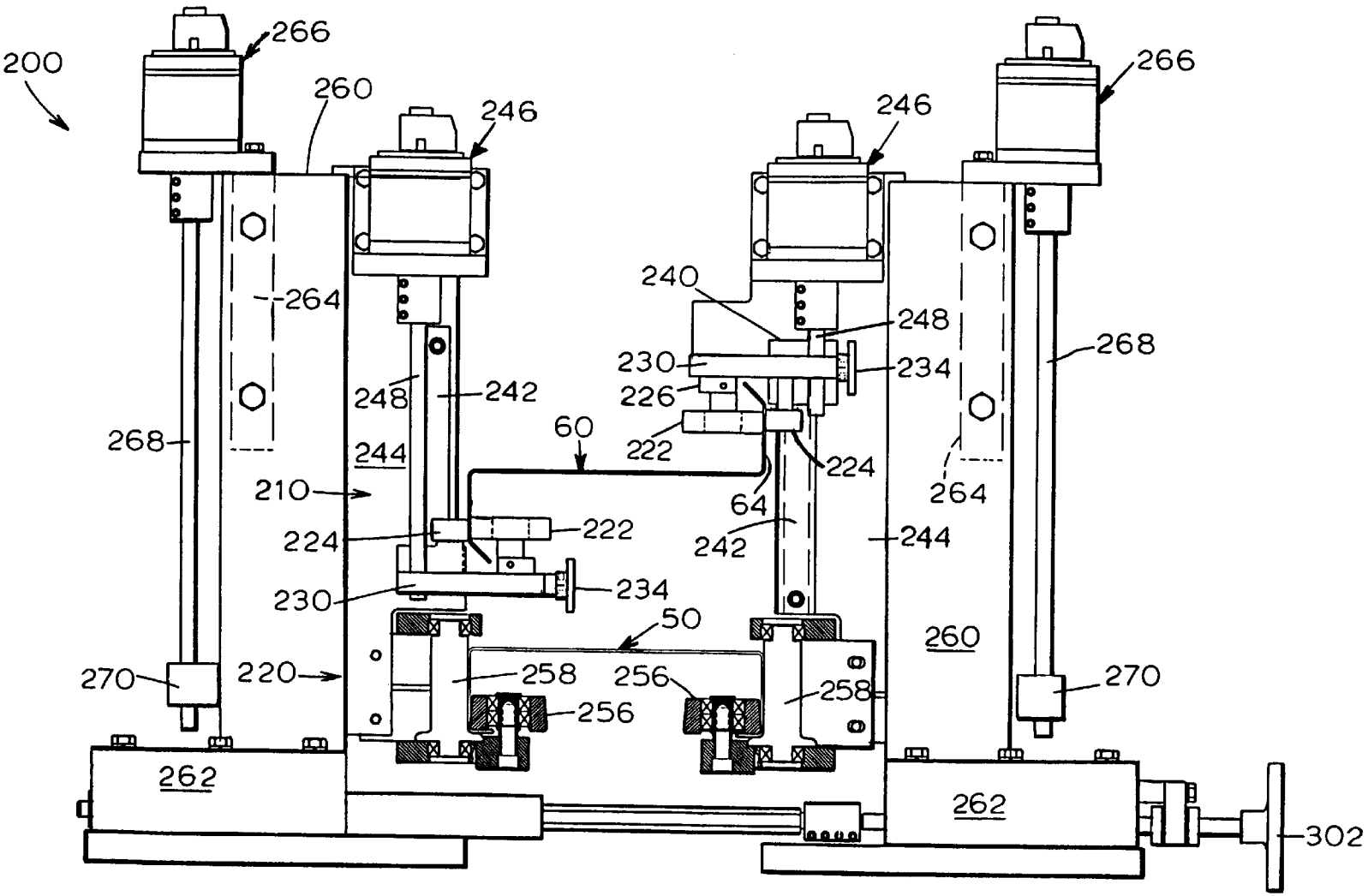
FIG. 8 is a first elevational view of a component straightener that may be incorporated in the roll-forming machine.
Figure 9:
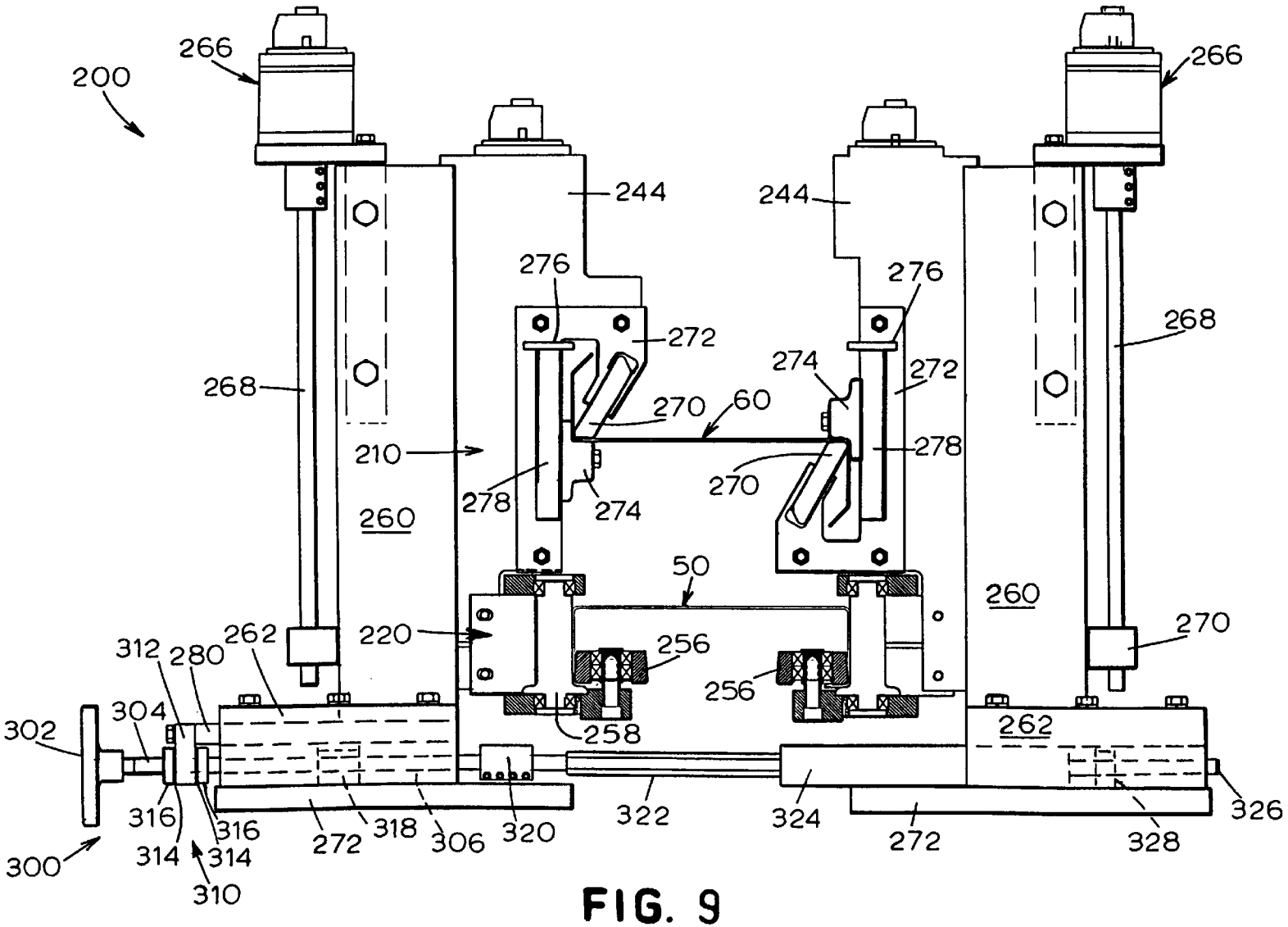
FIG. 9 is a second elevational view of the component straightener of FIG. 8.

Two elevational views of the component straightener 200 are shown in FIGS. 8 and 9. Referring to FIG. 8, the component straightener 200 includes a straightener fixture 210 for straightening Z-shaped components 60 and a straightener fixture 220 for straightening C-shaped components 50. The right-hand side of the straightener fixture 210 has a relatively large inner forming roll 222 and a pair of spaced-apart outer forming rolls 224, with the inner forming roll 222 being disposed directly adjacent the gap between the two outer forming rolls 224. All of the forming rolls 222, 224 are positioned to make contact with the leg 64 of a Z-shaped component 60.

Figure 10:
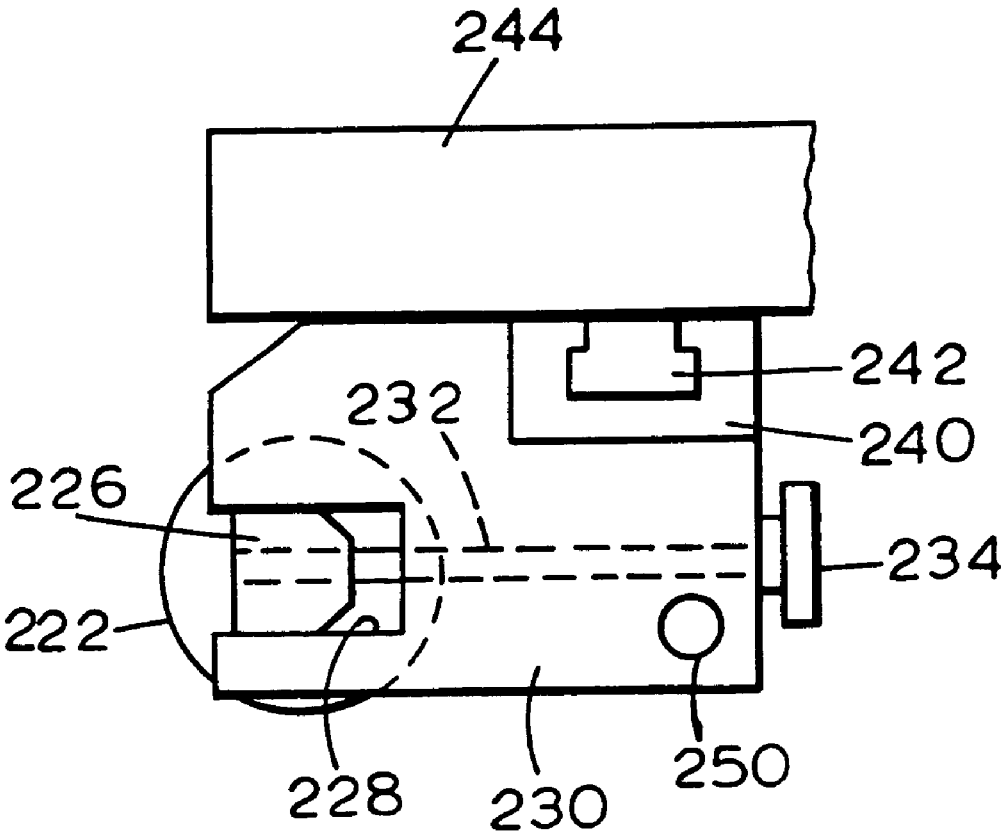
FIG. 10 is a top view of a portion of the component straightener.

The inner forming roll 222 is supported by a laterally adjustable plate 226. As shown in FIG. 10, the adjustable plate 226 is disposed within a U-shaped groove 228 formed in a support plate 230, and the adjustable plate 226 is internally threaded to receive a positioning screw 232 connected to an adjustment knob 234. Turning the positioning screw 232 causes the lateral position of the adjustable plate 226, and thus the lateral position of the inner forming roll 222, to be adjusted relative to the outer forming rolls 224, which are in a fixed position, being connected to the underside of the support plate 230.

Referring to FIG. 10, the support plate 230 is fixed to a slider block 240 which is slidably attached to a T-shaped guide rail 242 fixed to a movable frame member 244. A motor 246 is mounted to the top of the movable frame member 244, and the motor 246 is coupled to drive a positioning screw 248 that passes through a threaded hole 250 (FIG. 10) in the support plate 230. The motor 246 may be activated to turn the positioning screw 248 so as to raise or lower, relative to the movable frame member 244, the support plate 230 which supports the inner and outer forming rolls 222, 224.

The left-hand side of the straightener fixture 210 is of substantially the same design as the right-hand side described above, and the components of the left-hand side of the straightener fixture 210 which correspond with components of the right-hand side are designated with the same numerals.

Referring to the lower portion of FIG. 8, the right-hand side of the straightener fixture 220 for straightening C-shaped components has two inner forming rolls 256 and two pairs of bell-shaped outer forming rolls 258, each of the inner forming rolls 256 being disposed directly adjacent the gap between its associated pair of outer forming rolls 258. The forming rolls 256, 258 are disposed in a fixed vertical position relative to the movable frame members 244, and each of the inner forming rolls 256 is movable relative to its associated pair of outer forming rolls 258 by a respective sliding-block-and-positioning-screw assembly (not shown) like the one described above in connection with FIG. 10. If necessary or desired, the positioning screw used to adjust the position of the forming rolls 256 may be a conventional flexible positioning screw or drive shaft which is flexible while at the same time transmitting rotation from one of its ends to the other.

Each of the two movable frame members 244 is disposed between a pair of vertically stationary frame members 260, with two of the stationary frame members 260 disposed on each side of the component straightener 200. Each of the stationary frame members 260 is supported by a base portion 262, and each pair of the stationary members 260 is spaced apart with a vertically stationary frame member 264 disposed therebetween.

Each of the frame members 264 supports a motor 266, and each motor 266 is coupled to drive a rotatable positioning screw 268 threaded through a threaded aperture in a respective coupler 270, each of which is attached to one of the movable frame members 244 via a coupling assembly (not shown) disposed between each pair of frame members 260. In operation, the motors 266 may be used to raise or lower the movable frame members 244, and thus both of the straightening fixtures 210, 220, relative to the vertically stationary frame members 260 and the base portions 262.

Referring to FIG. 9, which is a side view of the component straightener 200 opposite that of FIG. 8, the straightener fixture 210 for Z-shaped components 60 also includes a pair of angled, inner forming rolls 270 rotatably supported by a pair of support members 272 fixed to the movable frame members 244 and a pair of bell-shaped, outer forming rolls 274 supported by the support members 272. The vertical position of each of the outer forming rolls 274 is adjustable via a knob 276 and a support assembly 278 (shown schematically) which includes a positioning screw (not shown) and an adjustable block (not shown) like the positioning assembly described above in connection with FIG. 10.

Referring to FIG. 9, the base portions 262 are bolted to a pair of support plates 272, which may be bolted to the support plates which support the roll stands 76, 78 of the last roll-forming station 34. Each of the base portions 262 has a pair of slots (not shown) formed therein, and a horizontal plate 280 is slidably disposed within each pair of the slots. The slidable plate 280 supports the vertically stationary frame members 260, so that those members 260 are slidable relative to the plate 272.

Each of the vertically stationary frame members 260 may be moved simultaneously to the right or to the left, relative to the plate 272, via a positioning mechanism 300 which includes a positioning wheel 302 coupled to a positioning screw 304 which passes through a hollow interior portion 306 in the base 262.

The positioning screw 304 passes through a retaining assembly 310 that is fixed to the slidable plate 280. The retaining assembly 310 may include a support member 312 having a hole through which the positioning screw 304 passes, a pair of washers 314, and a pair of threaded collars 316 fixed to the positioning screw 304, such as by a lock screw (not shown) threaded into each of the collars 316 that makes contact with the positioning screw 304. The positioning screw 304 also passes through a threaded block 318 fixed to the plate 272.

As the positioning wheel 302 is rotated, the positioning screw 304 rotates and moves horizontally relative to the threaded block 318. At the same time, the threaded collars 316 rotate and translate horizontally with the positioning screw 304, causing the support member 312, the slidable plate 280, and the frame member 260 supported by the slidable plate 280 to also horizontally translate relative to the plate 272.

The end of the positioning screw 304 is connected via a coupler 320 to a shaft 322 having a hexagonally shaped cross section. The shaft 322 is disposed within and slidable relative to a sleeve 324 having a hexagonally shaped recess formed therein. The sleeve 324 is fixed to a second positioning screw 326, which passes through a threaded block 328 fixed to the right-hand support plate 272. The positioning screw 326 also passes through a retaining assembly (not shown) similar to the retaining assembly 310 described above, which retaining assembly is connected to a support plate (not shown) that is slidable relative to the right-hand frame members 260.

When the positioning wheel 302 is turned, the hexagonal shaft 322 rotates with the positioning screw 304, forcing the sleeve 324 and the positioning screw 326 to rotate as well, and causes the right-hand frame members 260 to horizontally translate in the same direction as the left-hand frame members 260 in the same manner as described above.

The use of the shaft 322 that is hexagonally keyed into the sleeve 324 allows the left-hand and right-hand frame members 260 to be moved closer together and farther apart (the shaft 322 is slidable within the sleeve 324) while at the same time transmitting rotation from the positioning screw 304 to the positioning screw 326. The lateral spacing of the frame members 260 may be adjusted, to accommodate components of different widths, by mounting the plates 272 to the same support plates, described above, that support the roll stands 76, 78 of the roll-forming stations 18–34, so that the adjustment of the spacing of those roll stands 76, 78 automatically results in the proper adjustment of the lateral spacing of the frame members 260 of the component straightener 200.

In operation of the roll-forming machine 10, either C-shaped components 50 or Z-shaped components 60 pass through the last roll-forming station 34 at a predetermined elevation. If Z-shaped components 60 are being formed, the upper straightener 210 is vertically positioned (via the motors 266) so that its elevation matches that of the last roll-forming station 34. If C-shaped components 50 are being formed, the lower straightener 210 is vertically positioned (via the motors 266) so that its elevation matches that of the last roll-forming station 34.

In order to correct for twist of a component, one side of the straightener 210 or 220 being used is raised or lowered, relative to the other side of the straightener, to take the twist out of the component. For example, one of the motors 266 would be driven to raise or lower the right-hand movable frame members 260 relative to the left-hand frame members 260. In order to correct for flare of a component, one of the inner forming rolls 222, 256 would be moved in or out relative to the outer forming rolls 224, 258.

In order to correct for vertical bow of a component, the movable frame members 260 of both sides of the component straightener 200 would be moved simultaneously up or down via the motors 266. This would cause a bow in the opposite vertical direction since a portion of the component would still be retained within at least the last roll-forming station 34.

In order to correct for horizontal bow of a component, the positioning wheel 302 would be rotated in one direction or the other, so that both of the frame members 260 would be moved either to the right or to the left, as described above. this would cause a bow in the opposite horizontal direction since a portion of the component would still be retained within at least the last roll-forming station 34.

Numerous modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A roll-forming apparatus having a plurality of roll-forming stations adapted to form a first component having a Z-shaped cross section, said first component having a center portion, a pair of legs connected to said center portion, and a pair of flanges connected to said legs, said roll-forming stations being adapted to form a second component having a C-shaped cross section, said second component having a center portion, a pair of legs connected to said center portion of said second component, and a pair of flanges connected to said legs of said second component, said roll-forming apparatus comprising:

a first roll-forming station adapted to facilitate the formation of either a C-shaped or Z-shaped component from a sheet of material, said first roll-forming station making a pair of bends in said sheet of material at a first pair of laterally spaced locations on said sheet of material, said first roll-forming station comprising:

a first pair of forming rolls that make contact with said sheet of material;

a first telescoping arbor assembly that supports said first pair of forming rolls, said first telescoping arbor assembly having a variable length to allow the lateral distance between said first pair of forming rolls to be adjusted;

a second pair of forming rolls that make contact with said sheet of material; and a second telescoping arbor assembly that supports said second pair of forming rolls, said second telescoping arbor assembly having a variable length to allow the lateral distance between said second pair of forming rolls to be adjusted;

a second roll-forming station adapted to facilitate the formation of either a C-shaped or Z-shaped component from a sheet of material, said second roll-forming station making a pair of bends in said sheet of material at a second pair of laterally spaced locations on said sheet of material after said pair of bends are made in said sheet of material by said first roll-forming station, said second roll-forming station comprising:

a first pair of forming rolls that make contact with said sheet of material;

a first telescoping arbor assembly that supports said first pair of forming rolls of said second roll-forming station, said first telescoping arbor assembly of said second roll-forming station having a variable length to allow the lateral distance between said first pair of forming rolls of said second roll-forming station to be adjusted;

a second pair of forming rolls that make contact with said sheet of material; and a second telescoping arbor assembly that supports said second pair of forming rolls of said second roll-forming station, said second telescoping arbor assembly of said second roll-forming station having a variable length to allow the lateral distance between said second pair of forming rolls of said second roll-forming station to be adjusted;

a two-surface forming roll having a first forming surface and a second forming surface, said two-surface forming roll being positioned so that said first forming surface makes contact with said sheet of material when said sheet of material is being formed into a Z-shaped component and so that said second forming surface makes contact with said sheet of material when said sheet of material is being formed into a C-shaped component; and a forming roll support that supports said two-surface forming roll in a fixed position so that said two-surface forming roll may make contact with a sheet of material being formed into a C-shaped component when said two-surface forming roll is in said fixed position and so that said two-surface forming roll may make contact with a sheet of material being formed into a Z-shaped component when said two-surface forming roll is in said fixed position.

2. An apparatus as defined in claim 1 wherein said position of said two-surface forming roll may be adjusted to accommodate sheets of material having different thicknesses.

3. An apparatus as defined in claim 1 additionally comprising:

a movable forming roll having a forming surface; and a support that is adapted to support said movable forming roll in a first position in which said forming surface of said movable forming roll makes contact with a sheet of material that is being made into a Z-shaped component and in a second position in which said forming surface of said movable forming roll makes contact with a sheet of material that is being made into a C-shaped component.

4. An apparatus as defined in claim 1 wherein said bends made by said first roll-forming station and said bends made by said second roll-forming station are made at the same laterally spaced pair of locations on a sheet of material.

5. An apparatus as defined in claim 1 wherein said first roll-forming station is adapted to facilitate the formation of said flanges of a component and wherein said second roll-forming station is adapted to facilitate the formation of said legs of a component.

6. A roll-forming apparatus having a plurality of roll-forming stations adapted to form a first component having a Z-shaped cross section, said first component having a center portion, a pair of legs connected to said center portion, and a pair of flanges connected to said legs, said roll-forming stations being adapted to form a second component having a C-shaped cross section, said second component having a center portion, a pair of legs connected to said center portion of said second component, and a pair of flanges connected to said legs of said second component, said roll-forming apparatus comprising:

a first roll-forming station adapted to facilitate the formation of either a C-shaped component or a Z-shaped component from a sheet of material, said first roll-forming station making a pair of bends in said sheet of material at a first pair of laterally spaced locations on said sheet of material, said first pair of laterally spaced locations being laterally spaced apart by a first distance, said first roll-forming station comprising:

a first pair of forming rolls that make contact with said sheet of material;

a first telescoping arbor assembly that supports said first pair of forming rolls, said first telescoping arbor assembly having a variable length to allow the lateral distance between said first pair of forming rolls to be adjusted;

a second pair of forming rolls that make contact with said sheet of material; and a second telescoping arbor assembly that supports said second pair of forming distance between said second pair of forming rolls to be adjusted;

a second roll-forming station adapted to facilitate the formation of either a C-shaped component or a Z-shaped component from a sheet of material, said second roll-forming station making a pair of bends in said sheet of material at a second pair of laterally spaced locations on said sheet of material after said pair of bends are made in said sheet of material by said first roll-forming station, said second pair of laterally spaced locations being laterally spaced apart by a second distance, said second distance being smaller than said first distance, said second roll-forming station comprising:

a first pair of forming rolls that make contact with said sheet of material;

a first telescoping arbor assembly that supports said first pair of forming rolls of said second roll-forming station, said first telescoping arbor assembly of said second roll-forming station having a variable length to allow the lateral distance between said first pair of forming rolls of said second roll-forming station to be adjusted;

a second pair of forming rolls that make contact with said sheet of material; and a second telescoping arbor assembly that supports said second pair of forming rolls of said second roll-forming station, said second telescoping arbor assembly of said second roll-forming station having a variable length to allow the lateral distance between said second pair of forming rolls of said second roll-forming station to be adjusted;

a two-surface forming roll having a first forming surface and a second forming surface, said two-surface forming roll being positioned so that said first forming surface makes contact with a sheet of material being formed into a Z-shaped component and so that said second forming surface makes contact with a sheet of material being formed into a C-shaped component; and a forming roll support that supports said two-surface forming roll in a fixed position so that said two-surface forming roll may make contact with a sheet of material being formed into a C-shaped component when said two-surface forming roll is in said fixed position and so that said two-surface forming roll may make contact with a sheet of material being formed into a Z-shaped component when said two-surface forming roll is in said fixed position.

7. A roll-forming apparatus having a plurality of roll-forming stations adapted to form a first component having a Z-shaped cross section, said first component having a center portion and a pair of legs connected to said center portion, said roll-forming stations being adapted to form a second component having a C-shaped cross section, said second component having a center portion and a pair of legs connected to said center portion of said second component, said roll-forming apparatus comprising:

a first roll-forming station adapted to facilitate the formation of either a C-shaped component or a Z-shaped component from a sheet of material, said first roll-forming station making a bend in said sheet of material and comprising a plurality of forming rolls;

a second roll-forming station adapted to facilitate the formation of either a C-shaped component or a Z-shaped component from a sheet of material, said second roll-forming station making a bend in said sheet of material and comprising a plurality of forming rolls;

a two-surface forming roll having a first forming surface and a second forming surface, said two-surface forming roll being positioned so that said first forming surface makes contact with said sheet of material when said sheet of material is being formed into a Z-shaped component and so that said second forming surface makes contact with said sheet of material when said sheet of material is being formed into a C-shaped component; and a forming roll support that supports said two-surface forming roll in a fixed position, for a sheet of material having a given thickness, so that said two-surface forming roll may make contact with a sheet of material having said given thickness and being formed into a C-shaped component when said two-surface forming roll is in said fixed position and so that said two-surface forming roll may make contact with a sheet of material having said given thickness and being formed into a Z-shaped component when said two-surface forming roll is in said fixed position.

8. An apparatus as defined in claim 7 wherein said position of said two-surface forming roll may be adjusted to accommodate sheets of material having different thicknesses.

9. An apparatus as defined in claim 7 additionally comprising:

a movable forming roll having a forming surface; and a support that is adapted to support said movable forming roll in a first position in which said forming surface of said movable forming roll makes contact with a sheet of material being made into a Z-shaped component and in a second position in which said forming surface of said movable forming roll makes contact with a sheet of material being made into a C-shaped component.

10. An apparatus as defined in claim 9 wherein one of said roll-forming stations comprises a pair of laterally spaced support plates and wherein said support that supports said movable forming roll is coupled to one of said support plates.

11. A roll-forming apparatus having a given number of roll-forming stations adapted to form a first component having a Z-shaped cross section, said first component having a center portion and a pair of legs connected to said center portion, said roll-forming stations being adapted to form a second component having a C-shaped cross section, said second component having a center portion and a pair of legs connected to said center portion of said second component, said roll-forming apparatus comprising:

a first roll-forming station which is adapted to facilitate the formation of either a C-shaped component or a Z-shaped component from a sheet of material, said first roll-forming station comprising a movable forming roll having a forming surface, said movable forming roll being movable between a first position in which said forming surface of said movable forming roll makes contact with a sheet of material being made into a Z-shaped component and a second position in which said forming surface of said movable forming roll makes contact with a sheet of material being made into a C-shaped component; and a plurality of second roll-forming stations which are adapted to facilitate the formation of either a C-shaped component or a Z-shaped component from a sheet of material, each of said second roll-forming stations comprising a plurality of fixed forming rolls that are disposed in fixed positions, for a sheet of material having a given thickness, so that said fixed forming rolls may make contact with a sheet of material having said given thickness and being formed into a C-shaped component when said fixed forming rolls are in said fixed positions and so that said fixed forming rolls may make contact with a sheet of material having said given thickness and being formed into a Z-shaped component when said fixed forming rolls are in said fixed positions, said second roll-forming stations not having any movable forming rolls that must be moved in order to make contact with a sheet of material having said given thickness and being formed into a C-shaped component and to make contact with a sheet of material being formed into a Z-shaped component.

12. An apparatus as defined in claim 11 wherein said roll-forming apparatus has a plurality of said first roll-forming stations, wherein said roll-forming apparatus has a total number of said plurality of first roll-forming stations, and wherein said total number of said first roll-forming stations does not exceed one-half of said given number of roll-forming stations in said roll-forming apparatus.

13. An apparatus as defined in claim 11 wherein said roll-forming apparatus has at least three of said second roll-forming stations.

14. An apparatus as defined in claim 11 wherein said roll-forming apparatus has at least four of said second roll-forming stations.

15. An apparatus as defined in claim 11 wherein said roll-forming apparatus has at least six of said second roll-forming stations.

16. An apparatus as defined in claim 11 wherein at least one of said second roll-forming stations additionally comprises a forming roll support that supports said forming roll of said one second roll-forming station in a fixed position so that said forming roll of said one second roll-forming station may make contact with a sheet of material being formed into a C-shaped component when said forming roll of said one second roll-forming station is in said fixed position and so that said forming roll of said one second roll-forming station may make contact with a sheet of material being formed into a Z-shaped component when said forming roll of said one second roll-forming station is in said fixed position.

17. An apparatus as defined in claim 16 wherein said forming roll of said one second roll-forming station comprises a forming roll having two forming surfaces.

18. An apparatus as defined in claim 17 wherein said position of said two-surface forming roll may be adjusted to accommodate sheets of material having different thicknesses.

19. An apparatus as defined in claim 11 wherein said first roll-forming station additionally comprises a support that is adapted to support said movable forming roll in a first position in which a forming surface of said movable forming roll makes contact with said sheet of material that is being made into a Z-shaped component and in a second position in which said forming surface of said movable forming roll makes contact with said sheet of material that is being made into C-shaped component.

20. An apparatus as defined in claim 19 wherein one of said roll-forming stations comprises a pair of laterally spaced support plates and wherein said support that supports said movable forming roll is coupled to one of said support plates.

21. A roll-forming station for facilitating the formation of either a Z-shaped component or a C-shaped component from a sheet of material, said roll-forming station making a pair of bends in said sheet of material at a first pair of laterally spaced locations on said sheet of material, said roll-forming station comprising:

a first pair of forming rolls that make contact with said sheet of material;

a first telescoping arbor assembly that supports said first pair of forming rolls, said first telescoping arbor assembly having a variable length to allow the lateral distance between said first pair of forming rolls to be adjusted;

a second pair of forming rolls that make contact with said sheet of material;

a second telescoping arbor assembly that supports said second pair of forming rolls, said second telescoping arbor assembly having a variable length to allow the lateral distance between said second pair of forming rolls to be adjusted;

a first support plate that rotatably supports a first end of each of said arbor assemblies;

a second support plate laterally spaced from said first support plate that rotatably supports a second end of each of said arbor assemblies;

a two-surface forming roll having a first forming surface and a second forming surface, said two-surface forming roll being positioned so that said first forming surface makes contact with a sheet of material being formed into a Z-shaped component and so that said second forming surface makes contact with a sheet of material being formed into a C-shaped component; and a forming roll support that supports said two-surface forming roll in a fixed position, for a sheet of material having a given thickness, so that said two-surface forming roll may make contact with a sheet of material having said given thickness and being formed into C-shaped component when said two-surface forming roll is in said fixed position and so that said two-surface forming roll may make contact with a sheet of material having said given thickness and being formed into Z-shaped component when said two-surface forming roll is in said fixed position.

22. A roll-forming station as defined in claim 21 wherein said position of said two-surface forming roll may be adjusted to accommodate sheets of material having different thicknesses.

23. A method of forming components comprising the steps of:

(a) feeding a first sheet of material into a roll-forming machine having a plurality of fixed roll-forming stations and a plurality of reconfigurable roll-forming stations so that said first sheet of material passes through each of said fixed and reconfigurable roll-forming stations so that said first sheet of material is formed into a C-shaped component, said reconfigurable roll-forming stations having a first configuration designed to produce C-shaped components and a second configuration designed to produce Z-shaped components and said fixed roll-forming stations having a single configuration designed to produce both C-shaped components and Z-shaped components;

(b) after said first sheet of material is formed into a C-shaped component, changing the configuration of each said reconfigurable roll-forming stations from said first configuration to said second configuration without changing said single configuration of said fixed roll-forming stations; and (c) feeding a second sheet of material into said roll-forming machine so that said second sheet of material passes through each of said fixed and reconfigurable roll-forming stations so that said second sheet of material is formed into a Z-shaped component.

24. A method of forming components comprising the steps of:

(a) feeding a first sheet of material into a roll-forming machine having a plurality of fixed roll-forming stations and a plurality of reconfigurable roll-forming stations so that said first sheet of material passes through each of said fixed and reconfigurable roll-forming stations so that said first sheet of material is formed into a Z-shaped component, said reconfigurable roll-forming stations having a first configuration designed to produce C-shaped components and a second configuration designed to produce Z-shaped components and said fixed roll-forming stations having a single configuration designed to produce both C-shaped components and Z-shaped components;

(b) after said first sheet of material is formed into a Z-shaped component, changing the configuration of each said reconfigurable roll-forming stations from said second configuration to said first configuration without changing said single configuration of said fixed roll-forming stations; and (c) feeding a second sheet of material into said roll-forming machine so that said second sheet of material passes through each of said fixed and reconfigurable roll-forming stations so that said second sheet of material is formed into a C-shaped component.

25. A roll-forming apparatus, comprising:

a plurality of roll-forming stations which are adapted to facilitate the formation of C-shaped components from sheets of material, said roll-forming stations also being adapted to facilitate the formation of Z-shaped components from sheets of material; and a component straightener that is adapted to straighten both C-shaped components and Z-shaped components, said component straightener comprising:

a frame;

a first straightener fixture associated with said frame, said first straightener fixture having at least two forming rolls and being adapted to straighten a C-shaped component;

a second straightener fixture associated with said frame, said second straightener fixture having at least two forming rolls and being adapted to straighten a Z-shaped component; and an actuator that causes said first straightener fixture to be aligned to receive C-shaped components from said roll-forming stations when said roll-forming stations are forming said C-shaped components, said actuator causing said second straightener fixture to be aligned to receive Z-shaped components from said roll-forming stations when said roll-forming stations are forming said Z-shaped components.

26. An apparatus as defined in claim 25 wherein said frame comprises a stationary frame portion and a movable frame portion supported by said stationary frame portion, wherein said first straightener fixture is supported by said movable frame portion, and wherein said second straightener fixture is supported by said movable frame portion.

27. An apparatus as defined in claim 25 wherein said actuator comprises a motor and a linear position mechanism coupled to said motor.

28. An apparatus as defined in claim 25 wherein one of said components being formed by said roll-forming stations exits one of said roll-forming stations at an exit elevation and wherein said actuator causes one of said straightener fixtures to be vertically moved to said exit elevation so that said one component enters said one straightener fixture at said elevation.

* * * * *